US008534434B2

(12) United States Patent
Crull

(10) Patent No.: US 8,534,434 B2
(45) Date of Patent: Sep. 17, 2013

(54) SINGLE AXIS TELESCOPING HANDLE

(75) Inventor: Jeffrey L. Crull, McFarland, WI (US)

(73) Assignee: Snap-On Incorporated, Kenosha, WI (US)

( * ) Notice: Subject to any disclaimer, the term of this patent is extended or adjusted under 35 U.S.C. 154(b) by 0 days.

(21) Appl. No.: 13/304,848

(22) Filed: Nov. 28, 2011

(65) Prior Publication Data

US 2013/0134003 A1 May 30, 2013

(51) Int. Cl.
*A45C 13/26* (2006.01)
*B25G 1/04* (2006.01)

(52) U.S. Cl.
USPC ..... 190/117; 190/39; 190/115; 16/113.1; 16/429; 280/655.1

(58) Field of Classification Search
USPC ..... 190/39, 115, 117; 16/113.1, 114.1, 16/403, 405, 429; 280/655.1; 220/757, 761
See application file for complete search history.

(56) References Cited

U.S. PATENT DOCUMENTS 4,538,709 A * 9/1985 Williams et al. ..... 190/18 A
4,759,431 A 7/1988 King et al.
5,167,306 A * 12/1992 Carrigan, Jr. ..... 190/18 A
5,197,579 A * 3/1993 Bieber et al. ..... 190/18 A
5,291,976 A * 3/1994 Ku ..... 190/18 A
5,370,409 A * 12/1994 Latouche ..... 280/47.26
5,407,040 A 4/1995 Hu
5,460,393 A 10/1995 Tsai
5,531,300 A * 7/1996 Tsai ..... 190/115
5,575,362 A 11/1996 Franklin et al.
5,581,847 A 12/1996 Hsieh
5,615,757 A * 4/1997 Chen ..... 190/115
5,683,097 A 11/1997 Fenton et al.
5,709,398 A 1/1998 Lu
5,781,964 A 7/1998 Lin et al.
5,901,822 A 5/1999 Tu
5,926,915 A * 7/1999 Chou ..... 16/405
5,943,936 A 8/1999 Deliman et al.
D425,301 S 5/2000 Sagol
6,065,574 A 5/2000 Miyoshi
6,131,928 A 10/2000 Tung
6,134,749 A 10/2000 Kuo
6,148,477 A 11/2000 Cheng
6,193,033 B1 * 2/2001 Sadow et al. ..... 190/18 A
6,202,254 B1 3/2001 Ezer
6,292,979 B1 * 9/2001 Kuo ..... 16/113.1
6,298,964 B1 * 10/2001 Sadow ..... 190/18 A
6,311,368 B1 11/2001 Sartori
6,378,674 B1 4/2002 Lee (Continued)

OTHER PUBLICATIONS

International Search Report and Written Opinion of Intl Searching Authority dated Jan. 8, 2013 App. No. PCT/US2012/061425.

*Primary Examiner* — Sue A Weaver
(74) *Attorney, Agent, or Firm* — Seyfarth Shaw LLP

(57) ABSTRACT

A handle assembly that includes two sets of handle members that are vertically engageable with one another and where at least one of the sets of handle members extends substantially across a width of the receiving portion in the housing or bag that receives the handle. The receiving portion can be integral with the housing such that no additional receiving portion needs to be produced during the manufacturing process, resulting in a less complex and expensive manufacturing operation. The handle can further include a detent mechanism to allow the handle to easily collapse into the housing without the need for a separate button and lock mechanism.

13 Claims, 6 Drawing Sheets

(56) References Cited

U.S. PATENT DOCUMENTS

| | | | | |
|---|---|---|---|---|
| 6,425,162 | B1 | 7/2002 | Wang | |
| 6,425,599 | B1 * | 7/2002 | Tsai | 280/652 |
| 6,561,328 | B1 | 5/2003 | Huang | |
| 6,575,493 | B1 | 6/2003 | Lowenstein | |
| 6,609,271 | B2 | 8/2003 | Kuo | |
| 6,761,366 | B1 | 7/2004 | Klemmensen et al. | |
| 6,898,823 | B2 | 5/2005 | Tsai | |
| 6,978,514 | B2 | 12/2005 | Kuo et al. | |
| 7,097,181 | B2 | 8/2006 | Sadow | |
| D630,851 | S | 1/2011 | Landau et al. | |
| 7,874,408 | B2 | 1/2011 | Suppancig | |
| 2002/0074774 | A1 | 6/2002 | Hsu et al. | |
| 2002/0139628 | A1 | 10/2002 | Chang | |
| 2003/0038007 | A1 | 2/2003 | Han | |
| 2005/0067245 | A1 | 3/2005 | Tsai | |
| 2007/0187912 | A1 | 8/2007 | Taulman et al. | |
| 2009/0026031 | A1 | 1/2009 | Wilczak et al. | |
| 2009/0064456 | A1 | 3/2009 | Chen | |

* cited by examiner

SINGLE AXIS TELESCOPING HANDLE

FIELD OF THE INVENTION

The present application relates generally to a handle assembly for baggage or a tool box. More particularly, the present application relates to a single axis telescoping handle that is slideably received in a receiving portion integrally located within a housing.

BACKGROUND OF THE INVENTION

Conventional baggage or containers can be carried in a variety of ways. Many bagagges or other types of luggage include wheels disposed on the bottom of the baggage that allow the user to roll the bag on the ground rather than having to lift the bag and carry it in mid-air. Wheeled baggage can also include four wheels to allow the user to push or pull the baggage when upright, or can include two wheels so that the user can push or pull the baggage when carried at an angle to the ground plane.

Collapsible or telescopic handles are commonly used with wheeled baggage 620 so that a user can walk upright and pull the baggage behind them. As shown in FIG. 6, the conventional handle assembly 600 typically includes two sets of first poles 605 and two sets of second poles 610 that can be telescopically collapsed into a receiving portion 615 of the baggage. To collapse the first poles 605 into the second poles 610, the user must typically press a release button 625 to release spring-loaded balls 630 or other detent mechanisms that are biased into a locking condition. By pressing the release button 625, the user can then push the first poles into the second poles 610, and further push the entire handle assembly 600 into the receiving portion 615 of the baggage.

SUMMARY OF THE INVENTION

The present application discloses a handle assembly that includes two sets of handle members that are vertically engageable with one another and where at least one of the sets of handle members extends substantially across a width of the receiving portion in the baggage that is adapted to telescopically receive the handle. Also, the receiving portion can be integral with the housing such that no additional receiving portion needs to be produced during the manufacturing process, resulting in a less complex and expensive manufacturing operation. The handle can further include a detent mechanism that is adapted to detain the handle in an extended position, and further release the handle to allow the handle to telescopically collapse into the housing without the need for a separate button and lock mechanism.

In particular, the present application discloses a handle assembly that is telescopically collapsible into a receiving portion of a housing, the handle assembly including a first handle member extending in a substantially vertical direction and telescopically receivable by the receiving portion, a second handle member telescopically receivable by the first handle member in the vertical direction, the first and second handle members extending substantially across a width of the receiving portion, the width being a direction substantially perpendicular to the vertical direction, wherein the first handle member and the second handle member are frictionally engageable with one another to maintain the first and second handle members in a partially vertically outstretched position.

In addition, the present application discloses a case including a housing that has a receiving portion integrally provided with rails, a handle assembly including a first handle member extending in a substantially vertical direction and slidably receivable by the rails, and a second handle member slidably receivable by the first handle member in the vertical direction, the first and second handle members extending substantially across a width of the receiving portion, the width being a direction substantially perpendicular to the vertical direction.

The present application further discloses a method of collapsing a handle into a housing including providing a handle including a first handle member and a second handle member frictionally engageable with the first handle member; applying a collapsing force to overcome the frictional engagement of the first handle member and the second handle member to thereby collapse the handle; and continuing the collapsing force until the first handle member and the second handle member are substantially concealed by the housing.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages should be readily understood and appreciated.

DETAILED DESCRIPTION OF THE PREFERRED EMBODIMENTS

Figure 1:
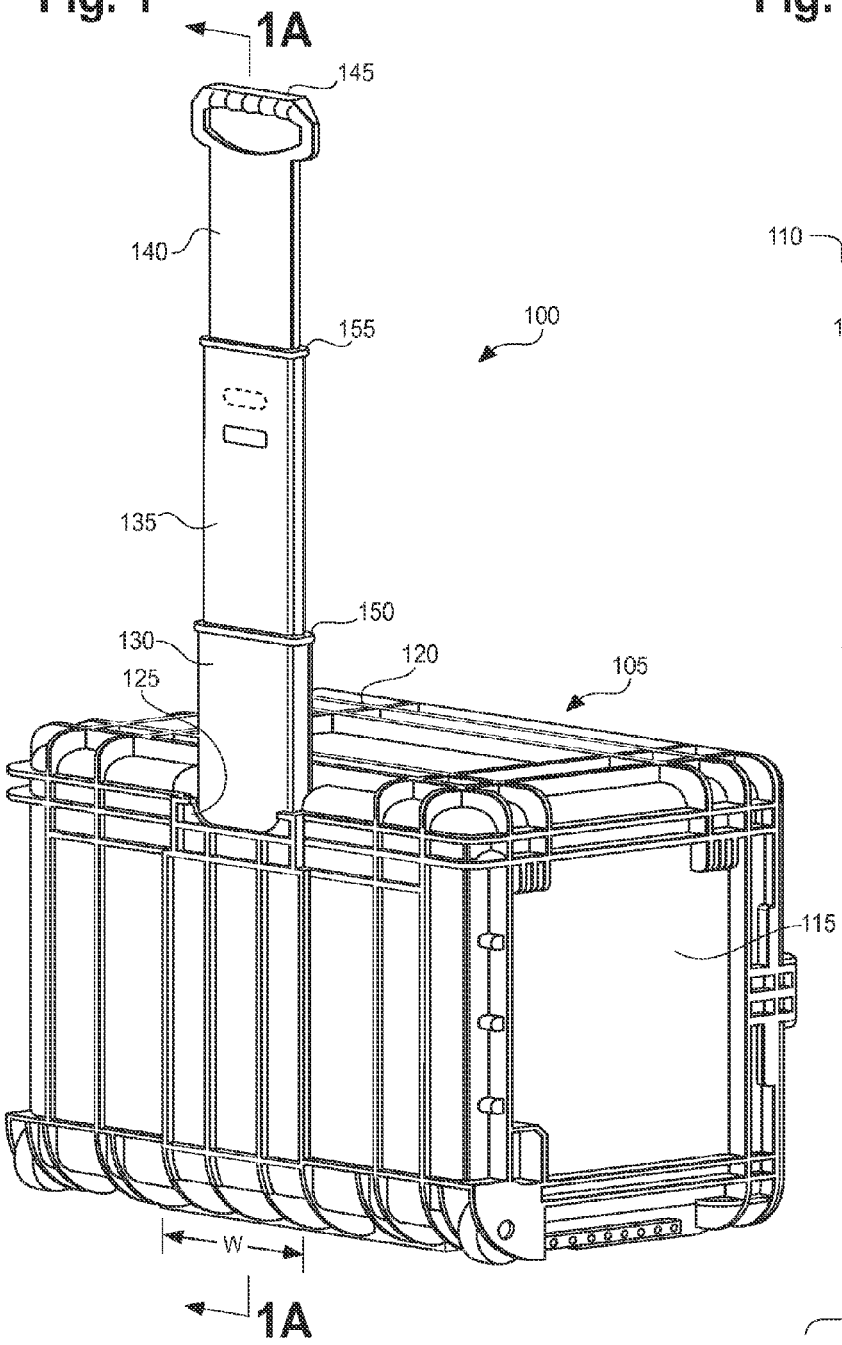
FIG. 1 is a perspective view of a baggage incorporating an embodiment of the handle and housing assembly of the present application with the handle in the outstretched position.
Figure 1A:
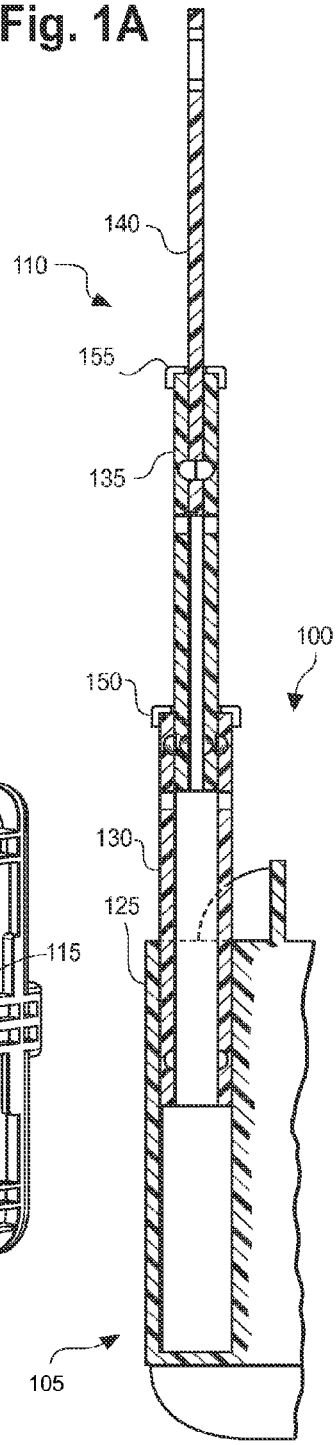
FIG. 1A is a sectional view of an embodiment of the handle according to the present application.

While the present invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

The present application discloses a handle assembly that includes two sets of handle members that are vertically engageable with one another and where at least one of the sets of handle members extends substantially across a width of the receiving portion in the luggage that receives the handle, making the handle more structurally stable and capable of receiving a heavy load. Also, the receiving portion can be integral with the housing such that no additional receiving portion needs to be produced during the manufacturing process, resulting in a less complex and expensive manufacturing operation. The handle can further include a detent mechanism or other frictional engagement system to allow the handle to telescopically collapse into the housing without the need for a lock release, as with conventional handles.

As shown in FIG. 1, the baggage 100, such as a tool case, includes a housing 105 and a handle 110 slidably received within the housing 105. The housing 105 includes a base 115 and a lid 120 enclosing the base 115, and further includes a receiving portion 125 that is adapted to slidably receive the handle 110 when the handle 110 is collapsed and inserted into the housing 105. In an embodiment, the handle 110 includes a first handle member 130 vertically receiving a second handle member 135 and an extension portion 140 extending above the first 130 and second 135 handle members and vertically received within the second handle member 135. The extension portion 140 includes a grip member 145 that is adapted to receive an external force from, for example, a user. A first shelf 150 is provided on the first handle member 130 to impede further upward movement of the extension portion 140. Similarly, a second shelf 155 is provided on the second handle member 135 to impede motion of the extension portion 140.

The housing 105 can be any container, luggage, bag or enclosure without departing from the spirit and scope of the present application. For example, the housing 105 can be a wheeled baggage device where the user can pull the housing 105 using the handle 110. In an embodiment, the housing 105 is a tool container.

The lid 120 of the housing 105 is coupled to the base 115 to enclose the base 115 in a well known manner. For example, lid 120 can be coupled to the base 115 by hinges, screws, a friction fit, or the lid 120 can simply rest on top of the base 115 without any structural attachment to the lid 120.

In an embodiment, the receiving portion 125 of the housing 105 includes structure that is adapted to receive the handle 110 when the handle 110 is collapsed to conceal a substantial portion of the first handle member 130 and the second handle member 135. In an embodiment, the receiving portion 125 includes a structure that is integral with the housing 105 and that receives the handle 110. For example, the receiving portion 125 can be injection molded together with the base 115 of the housing 105 so that the receiving portion 125 can be homogenously constructed of the same material as the housing 105.

The first handle member 130 and the second handle member 135 are adapted to slide within the receiving portion 125 of the housing 105 in a vertical direction relative thereto. In an embodiment, the first handle member 130 is constructed of a pair of brackets that are joined together by a first shelf 150, and the second handle member 135 is similarly constructed of a pair of brackets that are joined together by a second shelf 155. The extension member 140 is adapted to be slidably received in a vertical direction inside the second handle member 135 and the second handle member 135 is adapted to be slidably received in a vertical direction inside the first handle member 130. In an embodiment, the first handle member 130, the second handle member 135, and the extension portion 140 are each made of extruded aluminum to obtain a structurally stable configuration while maintaining a minimal weight of material. Alternately, the extension portion 140 can be constructed of other light weight materials, such as plastic, titanium or other materials to reduce the overall weight of the case 100.

In an embodiment, a grip member 145 can be disposed at an end of the extension portion and can include a structure that is adapted to allow a user to grip the handle 110, such as when pulling the baggage, and to apply a collapsing force or a lifting force, or any other type of force, to the handle 110. As shown, the grip member 145 includes a portion adapted to receive a hand of a user, including structure that receives the user's fingers to provide a more comfortable gripping area. However, the grip member 145 is not limited to the illustrated embodiment, and can include any structure that allows a user to grip and apply a force to the handle 110, for example, a ball, ring, T-shaped structure, or any other similar structure.

As shown in FIG. 1, the handle 110 extends substantially across a width W of the receiving portion. Accordingly, the handle 110 of the present application includes a first handle member 130 and a second handle member 135 that substantially extend a width W in order to increase structural stability and ease of use of the handle 110. In an embodiment, the first handle member 130 is adapted to engage rails or other receiving structure provided in the receiving portion 125 at the far width-wise ends of the first handle member 130. This configuration allows the first handle member 130 to substantially extend the width W of the receiving portion 125 and grip onto the structure within the receiving portion 125 with the opposing brackets of the first handle member 130.

Figure 2:
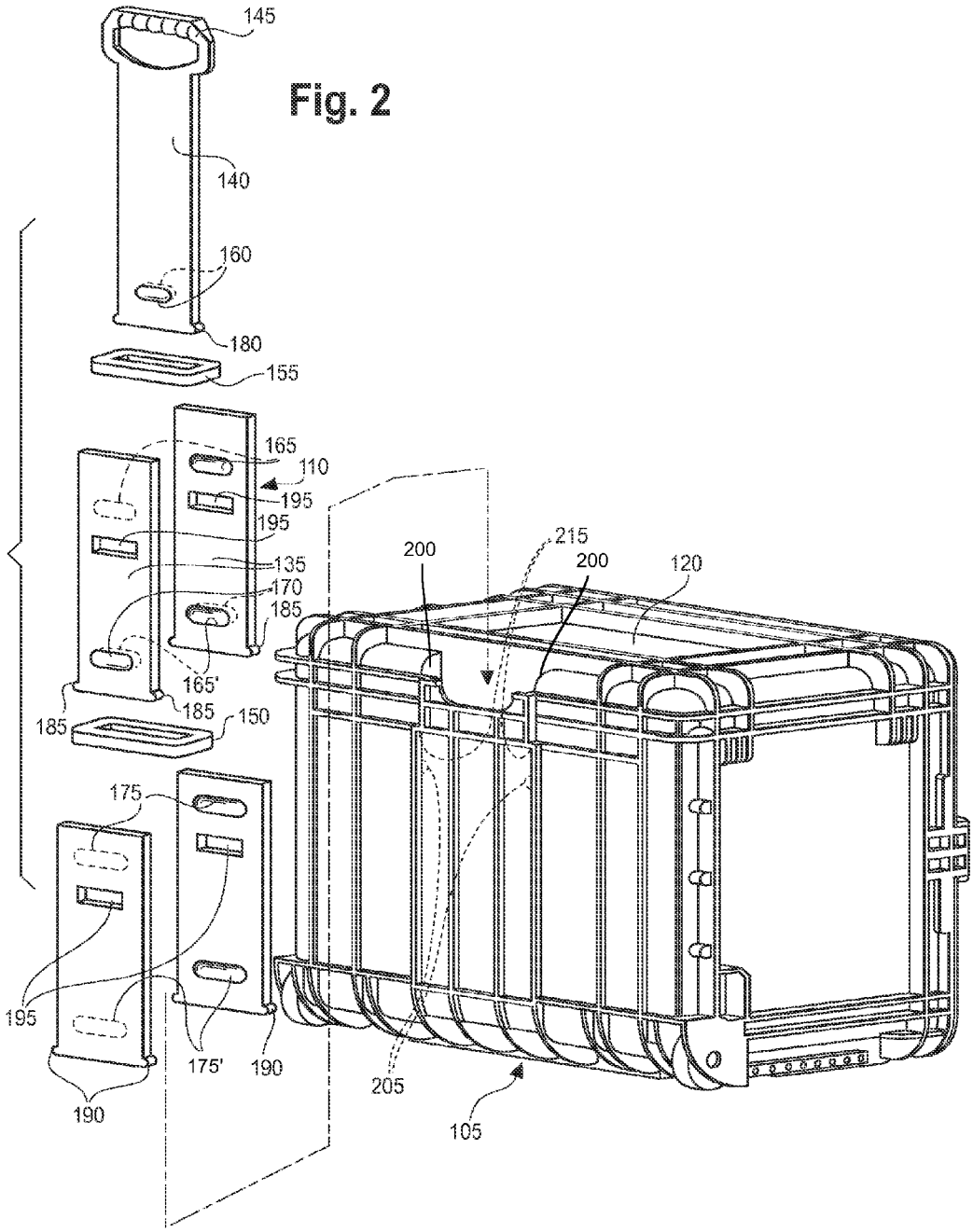
FIG. 2 is an exploded, perspective view of an embodiment of the handle and housing assembly of the present application.
Figure 3:
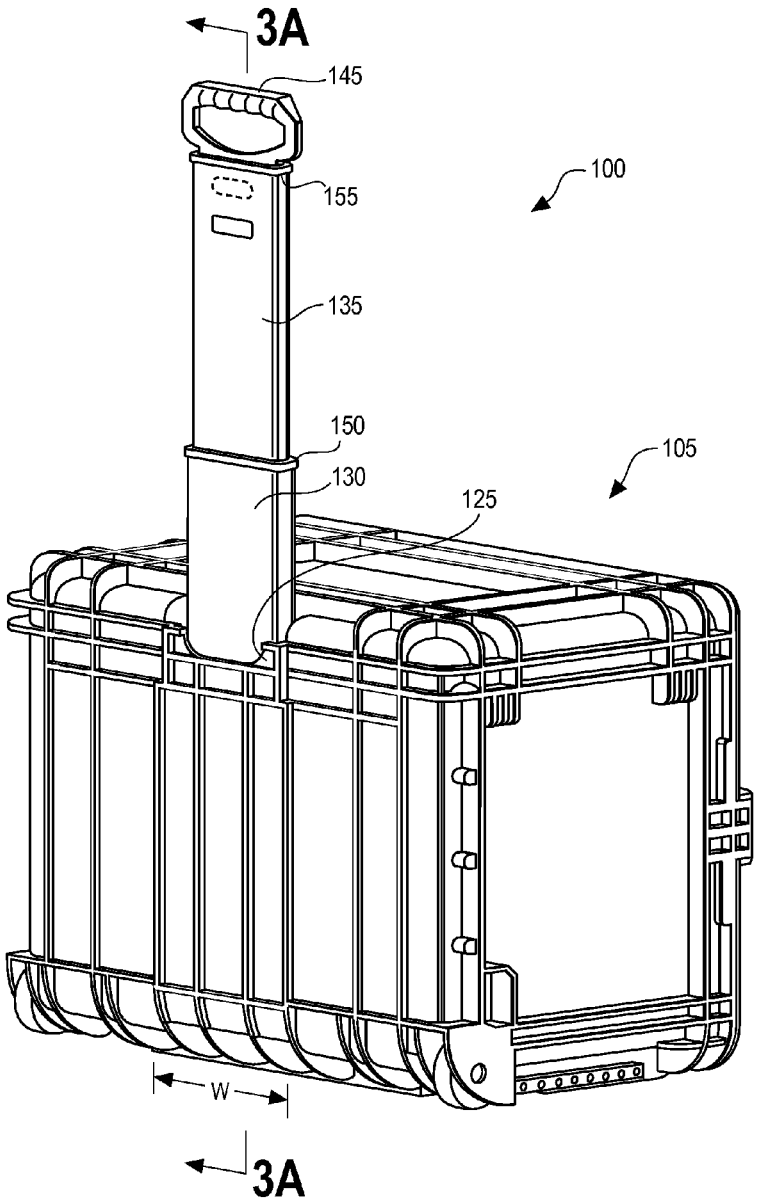
FIG. 3 is a perspective view of the baggage incorporating an embodiment of the handle and housing assembly of FIG. 1, where the handle is retracted slightly into the housing.
Figure 3A:
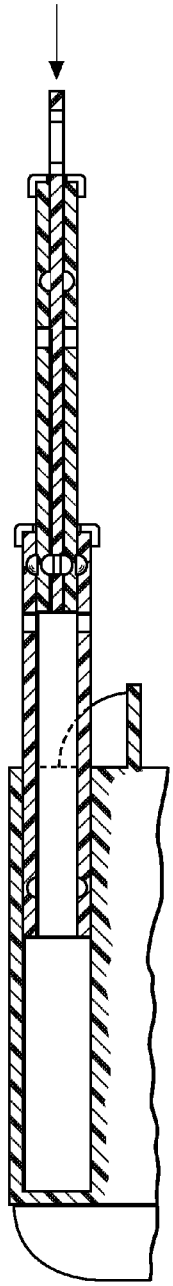
FIG. 3A is a sectional view of the handle as retracted in FIG. 3.

FIG. 2 illustrates an exploded view of the handle according to the present application. As shown, the handle 110 includes various detents and indents that allow the handle 110 to temporarily remain in different vertical positions. In an embodiment, the handle 110 can include the first handle member 130, second handle member 135 and the extension portion 140 that telescopically collapse upon one another with the aid of detents and indents. In an embodiment, the handle members 130, 135 can be collapsed to form a 42-inch handle position (as shown in FIG. 1) or a 35-inch handle position (as shown in FIG. 3), although it will be appreciated that other positions can be obtained without departing from the scope and spirit of the present application.

As shown in FIG. 2, the extension portion 140 includes a first detent 160 disposed on an external surface of the extension portion 140 and adapted to matingly engage a first indent 165 that is disposed on an internal surface of the second handle member 135. Similarly, the second handle member 135 includes a second detent 170 disposed on an external surface of the second handle member 135 and matingly engageable with a second indent 175 disposed on an internal surface of the first handle member 130. In an embodiment, the extension portion 140 includes two first detents 160, one on each opposing side of the extension portion 140, to allow a more symmetric engagement with two of the first indents 165 disposed on the second handle member 135. Moreover, two second detents 170 and two second indents 175 can be provided in the same manner. It will be appreciated that any number of first detents 160, first indents 165, second detents 170 and second indents 175 can be incorporated into the handle without departing from the spirit and scope of the present application. In addition, the indents and detents can be any shape or size, and can be located anywhere on the handle 110.

In an embodiment, as shown in FIG. 2, the extension portion 140, the first handle member 130 and the second handle member 135 respectively include a first ledge 180, a second ledge 185, and a third ledge 190. The first ledge 185 and the second ledge 190 abut against a bottom surface of the first shelf 150 and the second shelf 155, respectively. The third ledge 190 abuts a top surface of the receiving portion 125. The ledges prevent the components of the handle 110 from disconnecting from one another when the handle 110 is pulled outwardly. For example, if a user pulls the handle 110 outwardly, the second ledge 185 will abut a bottom surface of the second shelf 155 and prevent the second handle member 135 from being completely withdrawn from the first handle member 130 and the extension portion 140.

In an embodiment, the first handle member 130, second handle member 135 and extension portion 140 can further include vents 195 that allow air to flow through the handle 110 components to help prevent a vacuum from forming at the interface between the components. As shown, the vents 195 are oval shaped, but it can be appreciated that the vents 195 can be any size and shape, and any number of vents 195 can be provided on the first handle member 130, second handle member 135 and extension portion 140, without departing from the spirit and scope of the present application.

In an embodiment, as shown in FIG. 2, the receiving portion 125 can include rails 200 that extend downwardly along the receiving portion 125 and is adapted to receive the two brackets of, for example, the second handle member 135. The two brackets of the second handle member 135 are each adapted to grip the rails 200 and slide within the rails 200. However, any other configuration in which the receiving portion 125 slidably receives the handle 110 can be implemented without departing from the spirit and scope of the present application. For example, the receiving portion 125 can include a ball bearing design that allows the handle 110 to move within the receiving portion with minimal friction. Alternately, the receiving portion 125 can define an indented track and protrusions from the handle 110 can insert into the track. In an embodiment, the receiving portion 125 is integral with the base 115 of the housing 105 or is homogenously constructed of the same material as the base 115.

In an embodiment, the receiving portion 125 can include internal detents 205 that engage indents on an external surface of the first handle member 130 to maintain the handle in an outstretched position, similar to the discussion above with the first and second detents 165, 170 and the first and second indents 175, 180. Similar to the first shelf 150 and the second shelf 155, the receiving portion 125 can include a shelf 215 that sufficiently impedes the movement of the first handle member 130 when the first handle member 130 extends outwardly and the third ledge 190 of the first handle member 130 abuts the shelf 215.

Figure 4:
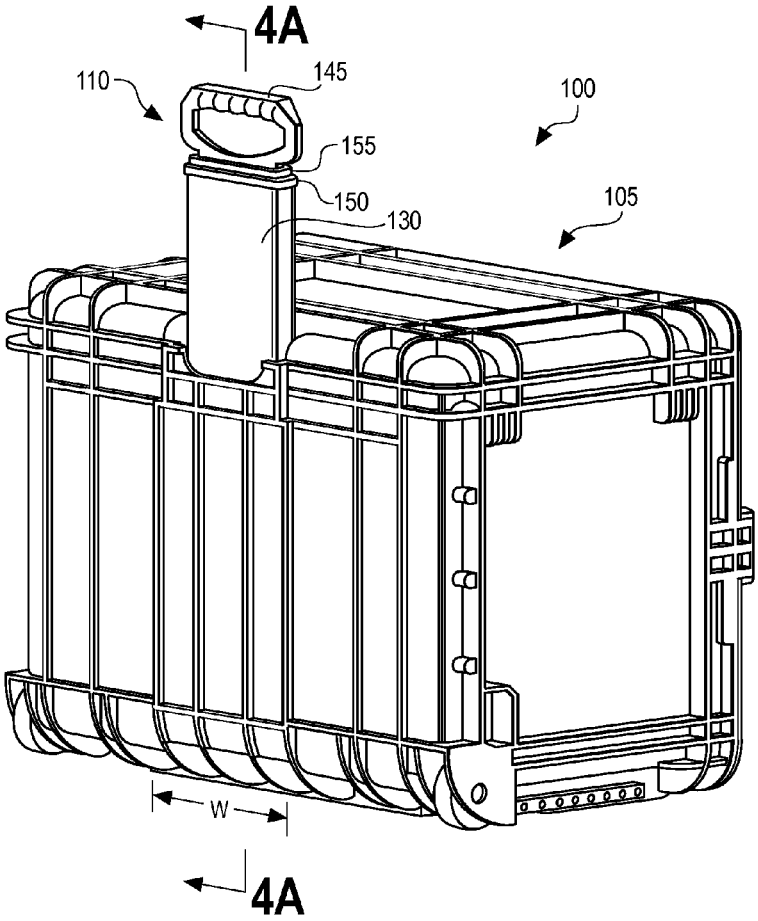
FIG. 4 is a perspective view of the baggage incorporating an embodiment of the handle and housing assembly of FIG. 1, where the handle is substantially retracted into the housing.
Figure 4A:
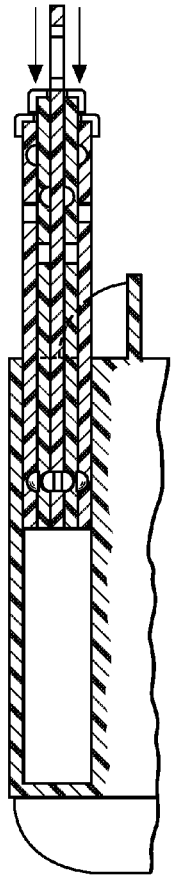
FIG. 4A is a sectional view of the handle as retracted in FIG. 4.
Figure 5:
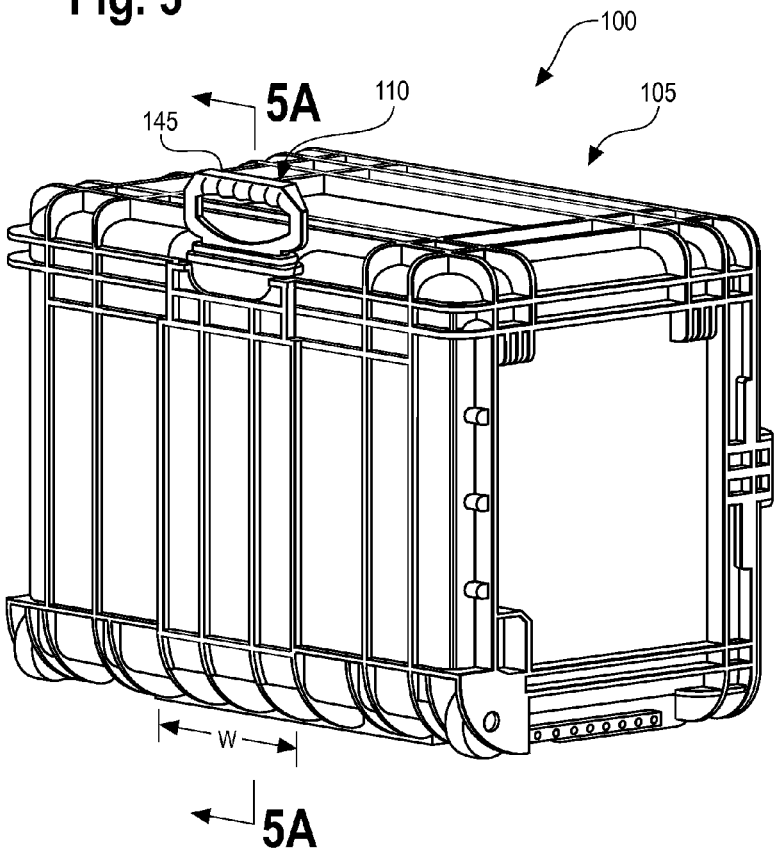
FIG. 5 is a perspective view of the baggage incorporating an embodiment of the handle and housing assembly of FIG. 1, where the handle is almost completely retracted into the housing.
Figure 5A:
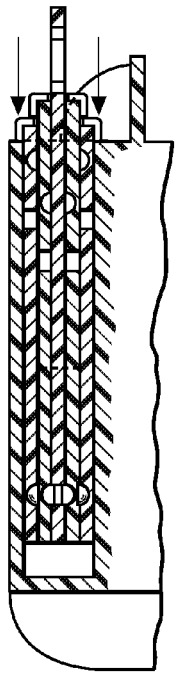
FIG. 5A is a sectional view of the handle as retracted in FIG. 5.
Figure 6:
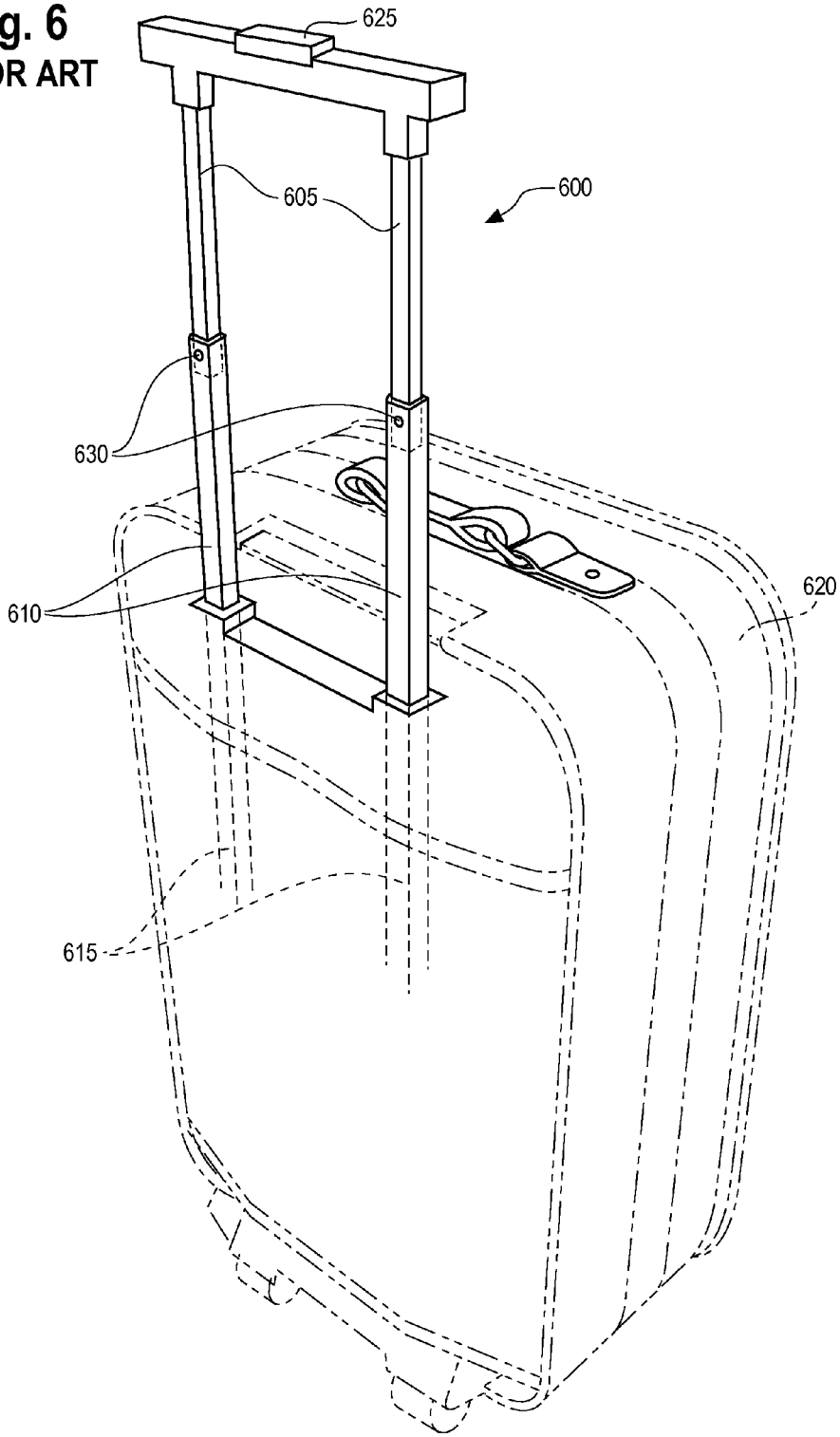
Fig. 6 PRIOR ART
FIG. 6 is a plan elevation view of a prior art handle and housing assembly.

A method of operating the case 100 will now be described with reference to FIGS. 1, 3, 4, and 5. As shown in FIG. 1, the handle 110 is in an outstretched position where the extension member 140 stretches above the second handle member 135, and with the detent mechanisms described above, maintains in place. The user can then push down on the grip member 145 of the handle 110 and push the extension portion into the second handle member 135 against the frictional forces between the first detent 160 and first indent 165, as shown in FIG. 3. Thereafter, the user can continue pushing on the grip member 145 against the friction forces of the second detent 170 and second indent 175, as shown in FIG. 4. The user can continue pushing on the grip member 145 until the handle 110 is substantially concealed by the receiving portion 125, where only the grip member 145 is substantially visible, as shown in FIG. 5.

The manner set forth in the foregoing description and accompanying drawings and examples, is offered by way of illustration only and not as a limitation. More particular embodiments have been shown and described, and it will be apparent to those skilled in the art that changes and modifications may be made without departing from the broader aspects of Applicant's contribution. The actual scope of the protection sought is intended to be defined in the following claims when viewed in their proper prospective based on the prior art.

What is claimed is:

1. A collapsible handle assembly receivable in a receiving portion of a housing, the handle assembly comprising:

a first handle member including a first pair of opposing brackets coupled together and extending in a substantially axial direction and slidably receivable by the receiving portion;

a second handle member including a second pair of opposing brackets coupled together and slidably receivable between the first pair of opposing brackets in the axial direction, the first and second handle members extending substantially across a width of the receiving portion, the width being a direction substantially perpendicular to the axial direction; and a detent disposed on one of the first and second handle members and engageable with an indent disposed on the other of the first and second handle members to maintain the first and second handle members in a partially axially outstretched position.

2. The handle assembly of claim 1, wherein the receiving portion further includes a structure integrally disposed in the housing and adapted to slidably receive the first handle member.

3. The handle assembly of claim 1, wherein one of the first and second handle members includes a vent.

4. The handle assembly of claim 1, further comprising an extension portion receivable within the second handle portion and having a grip member adapted to be gripped by a user.

5. The handle assembly of claim 4, further comprising a first shelf and a second shelf respectively disposed on ends of the first handle member and the second handle member, the first shelf adapted to obstruct movement of the second handle member and the second shelf adapted to obstruct movement of the extension portion.

6. A baggage comprising:

a housing including a receiving portion integrally provided with a receiving structure;

a handle assembly including:

a first handle member including a first pair of opposing brackets coupled together, the first handle member extending in a substantially axial direction and slidably receivable by the receiving structure;

a second handle member including a second pair of opposing brackets coupled together and slidably receivable between the first pair of opposing brackets in the axial direction, the first and second handle members extending substantially across a width of the receiving portion, the width being a direction substantially perpendicular to the axial direction; and a detent disposed on one of the first and second handle members and engageable with an indent disposed on the other of the first and second handle members to maintain the first and second handle members in a partially axially outstretched position.

7. The handle assembly of claim 6, wherein one of the first and second handle members includes a vent.

8. The handle assembly of claim 6, further comprising an extension portion axially receivable within the second handle portion and having a grip member adapted to be gripped by a user.

9. The handle assembly of claim 8, further comprising a first shelf and a second shelf respectively disposed on ends of the first handle member and the second handle member, the first shelf adapted to obstruct axial movement of the second handle member and the second shelf adapted to obstruct axial movement of the extension portion.

10. A baggage device, comprising:

a housing including a base, a lid coupled to the base and adapted to open and close the base, and a receiving portion including rails disposed at opposing ends of the receiving portion and a receiving shelf disposed at an opening of the receiving portion;

a first handle member including a first pair of opposing brackets coupled together by a first shelf, the first pair of opposing brackets having a first width extending substantially across a width of the receiving portion, the first handle member being slidably received by the receiving portion in a substantially axial direction and adapted to engage the rails, the first pair of opposing brackets each having a first ledge adapted to abut against the receiving shelf to impede removal of the first handle member from the receiving portion, and the first pair of opposing brackets each having a first indent disposed on an internal surface;

a second handle member including a second pair of opposing brackets coupled together by a second shelf, the second handle member being slidably received between the first pair of opposing brackets in the axial direction and having a second width extending substantially across the width of the receiving portion, the second pair of opposing brackets each having a second ledge, a second indent disposed on an internal surface and a second detent disposed on an external surface, the second detents adapted to engage the first indents when the second handle member is extended from the first handle member and the second ledges being adapted to abut the first shelf to impede removal of the second handle member from the first handle member; and an extension portion slidably received between the second pair of opposing brackets in the axial direction, the extension portion including third detents on opposite external surfaces and a third ledge, the third detents adapted to engage the second indents when the extension portion is axially extended from the second handle member and the third ledge adapted to abut against the second shelf to impede removal of the extension portion from the second handle member, the extension portion including a grip member disposed at an end of the extension portion and adapted to receive an external force from a user, wherein application of a collapsing force to the grip by the user collapses the first handle member, the second handle member and the extension portion substantially into the receiving portion, and application of an extending force to the grip by the user extends the extension portion from the second handle member, extends the second handle member from the first handle member, and extends the first handle member from the receiving portion.

11. A method of collapsing a handle into a housing comprising:

providing a first handle member including a first pair of opposing brackets coupled together and a second handle member including a second pair of opposing brackets coupled together, one of the first and second handle members including an indent and the other of the first and second handle members including a detent engageable with the indent to form a detainable engagement between the first and second handle members;

applying a collapsing force to overcome the detainable engagement to thereby allow the handle to collapse; and continuing to apply the collapsing force until the first handle member and the second handle member are substantially concealed by the housing.

12. The method of claim 11, further comprising providing an extension portion slidably received by the second handle member, wherein the collapsing force is applied to the extension portion.

13. The method of claim 12, further comprising applying a lifting force in a direction opposite the collapsing force to lift the handle from the housing, wherein the second handle member includes the detent.

* * * * *